US011135847B2

(12) United States Patent
Huang et al.

(10) Patent No.: US 11,135,847 B2
(45) Date of Patent: Oct. 5, 2021

(54) MEDIA PRINTING

(71) Applicant: Hewlett-Packard Development Company, L.P., Spring, TX (US)

(72) Inventors: Pui Wen Huang, Singapore (SG); Wei Shan Gwenda Teo, Singapore (SG); Khee Peng Ngoon, Singapore (SG); Yi Xiong Anselm Lim, Singapore (SG); Sook Shin Chang, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 86 days.

(21) Appl. No.: 16/634,956

(22) PCT Filed: Jul. 31, 2017

(86) PCT No.: PCT/US2017/044766
§ 371 (c)(1),
(2) Date: Jan. 29, 2020

(87) PCT Pub. No.: WO2019/027436
PCT Pub. Date: Feb. 7, 2019

(65) Prior Publication Data

US 2020/0247121 A1 Aug. 6, 2020

(51) Int. Cl.

| | |
|---|---|
| ***B41J 2/145*** | (2006.01) |
| ***B41J 3/60*** | (2006.01) |
| ***B41J 11/00*** | (2006.01) |
| ***B41J 11/06*** | (2006.01) |
| ***B41J 13/03*** | (2006.01) |
| ***B41J 29/393*** | (2006.01) |

(52) U.S. Cl.
CPC ..... *B41J 2/145* (2013.01); *B41J 3/60* (2013.01); *B41J 11/008* (2013.01); *B41J 11/0035* (2013.01); *B41J 11/06* (2013.01); *B41J 13/03* (2013.01); *B41J 29/393* (2013.01); *B41J 2202/15* (2013.01)

(58) Field of Classification Search
CPC . B41J 2/145; B41J 3/60; B41J 11/0035; B41J 11/008; B41J 11/06; B41J 13/03; B41J 29/393; B41J 2202/15
See application file for complete search history.

(56) References Cited

U.S. PATENT DOCUMENTS

| | | | |
|---|---|---|---|
| 5,469,196 | A | 11/1995 | Okazaki et al. |
| 9,266,355 | B2 | 2/2016 | Raming |
| 2002/0030731 | A1 | 3/2002 | Yahagi et al. |
| 2010/0220130 | A1 | 9/2010 | Bruno et al. |

(Continued)

FOREIGN PATENT DOCUMENTS

| | | |
|---|---|---|
| JP | 7017097 | 1/1995 |
| RU | 2497683 C2 | 11/2013 |

(Continued)

*Primary Examiner* — Anh T Vo
(74) *Attorney, Agent, or Firm* — HP Inc. Patent Department

(57) ABSTRACT

Printing techniques for print media are described herein. In an example, a printer includes print head and a feed roller to move a medium under the print head along a print path. The print head includes a first set of nozzles such that the first set of nozzles is proximal to the feed roller. Further, the print head is to print on a Top-of-Form (TOF) of the medium through the first set of nozzles.

15 Claims, 11 Drawing Sheets

(56) References Cited

U.S. PATENT DOCUMENTS

| | | | | |
|---|---|---|---|---|
| 2011/0025743 | A1* | 2/2011 | Mizes | B41J 25/00 347/14 |
| 2011/0102530 | A1* | 5/2011 | Yamamoto | B41J 3/60 347/104 |
| 2014/0198153 | A1 | 7/2014 | Nakanishi | |

FOREIGN PATENT DOCUMENTS

| | | | |
|---|---|---|---|
| RU | 161249 | U1 | 4/2016 |
| WO | WO-2013162497 | A1 | 10/2013 |

* cited by examiner

MEDIA PRINTING

BACKGROUND

Printers, such as inkjet printers, include a print head having a plurality of nozzles for spraying ink on a medium, such as a sheet of paper. The printers also include a feed roller for transporting the medium under the print head. Under the print head, the medium is supported by a platen. While printing, the ink is sprayed on the medium through the plurality of nozzles to print a pattern on the medium.

BRIEF DESCRIPTION OF DRAWINGS

The following detailed description references the drawings, wherein.

DETAILED DESCRIPTION

Figure 1:
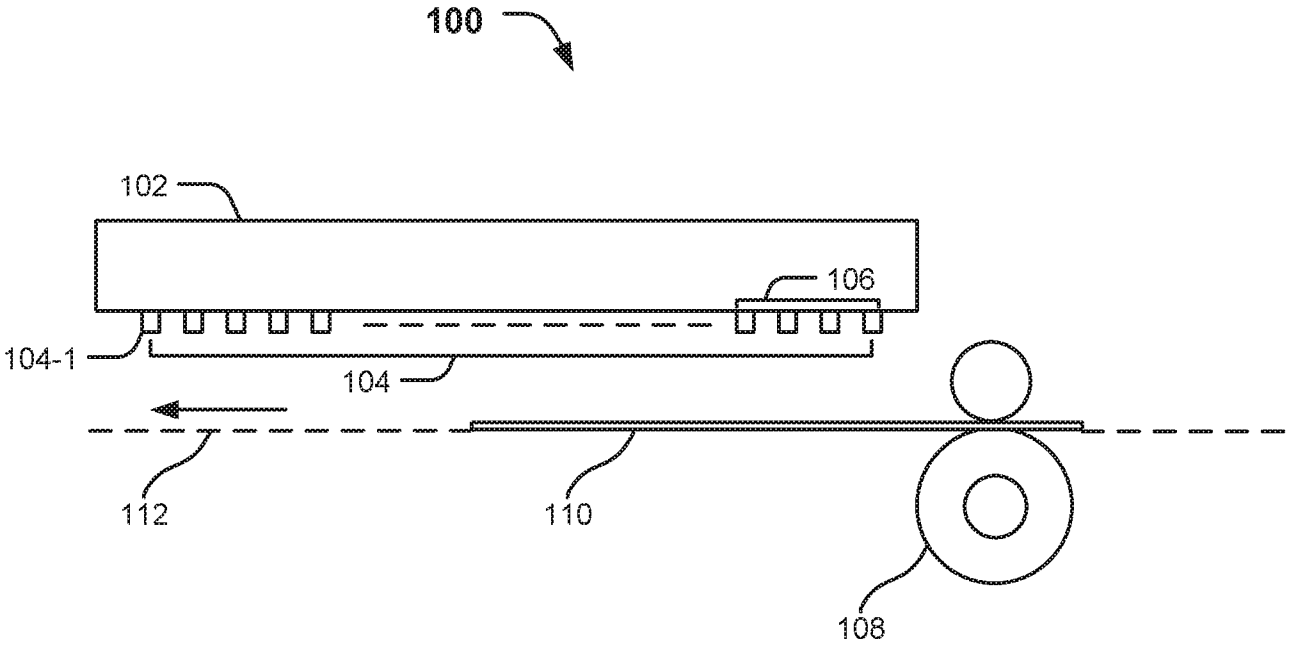
FIG. 1 illustrates a schematic of a printer, according to an example.

Inkjet printers include a print head, for spraying ink on a medium, and a platen for supporting the medium under the print head. The print head and the platen define a print zone therebetween. For providing high throughput, the printers may be provided with large print zones. Moreover, the printers may maintain small margins on the medium to efficiently perform printing. Though large print zones and small margins are effective for plain medium, such as a sheet of paper; in case of thick medium, such as an envelope, small margins may result in printing defects. As a result, to print the thick medium, separate printers with big margins and small print zones are designed. However, the small print zones affect printing speed of the printers, thereby reducing overall performance of the printers.

In addition, while printing, the ink may cause the medium to curve upward towards the print head. This upward curving may cause the medium to come in contact with the print head, thereby causing smearing of the ink as well as jams, In case of the plain medium, chances of smearing the ink are more during duplex printing, For example, when a Bottom-of-Form (BOF) of a first side of the plain medium is printed with a high-density ink, a Top-of-Form (TOF) of a second side of the plain medium is susceptible to smearing of the ink while getting printed.

The present subject matter describes example implementations of printers and techniques for printing on different mediums, such as a paper and an envelope, that have varying margins and printable areas. In an example, the techniques of the present subject matter enable a printer to print on a plain medium, for example a paper, as well as a thick medium, for example an envelope, by maintaining small margins, In addition, the techniques of the present subject matter facilitate in preventing contact of the medium with the print head of the printer, thereby reducing smearing of the ink and jamming of the medium.

According to an aspect, the printer includes a controller to determine whether the medium is a plain medium or a thick medium. Upon determining that the medium is the thick medium, a print head of the printer prints through a first set of nozzles on the TOF of the medium. In an example, first set of nozzles is proximal to a feed roller, The feed roller moves the medium along a print path in the print zone while creating a stress on the medium. The print head is movable away from the print path, after the TOF is printed. Thereafter, the medium is advanced further along the print path in the print zone such that the printed TOF of the medium moves outside the print zone. Further, the print head is movable back in the print path to print on an intermediate portion and a BOF of the medium. In an example, the BOF of the medium is printed through a second set of nozzles, which is being located distal from the feed roller.

According to another aspect, upon determining that the medium is the plain medium, it is determined whether the medium is subjected to one-sided (simplex) printing or two-sided (duplex) printing. In case of the simplex printing, the print head prints on the TOF of the plain medium with the plurality of nozzles to maximize printing speed. In case of the duplex printing, a density of the ink laid on a BOF of a first side of the plain medium is sensed. If a high-density ink is sensed, the print head prints through the first set of nozzles on a TOF of the second side of the plain medium. Once printed, the print head moves away from the print zone to prevent contact between the print head and the plain medium. After movement of the print head away from the print zone, the plain medium is advanced further in the print zone such that the printed TOF of the plain medium moves outside the print zone. Thereafter, the print head moves back in the print zone to print on a remaining printable area of the plain media through the plurality of nozzles.

The first set of nozzles and the second set of nozzles are selected in a way to enable maintaining small margins for the medium. Further, the advancement of the TOF of the medium outside the print zone prevents contact between the medium and the print head. Moreover, movement of the print head away from the print path of the medium facilitates in preventing contact between the print head and the medium. Accordingly, the present subject matter facilitates in preventing smearing of the ink and jamming of the medium without affecting the performance of the printer.

The following detailed description refers to the accompanying drawings. Wherever possible, the same reference numbers are used in the drawings and the following description to refer to the same or similar parts. While several examples are described in the description, modifications, adaptations, and other implementations are possible. Accordingly, the following detailed description does not limit the disclosed examples. Instead, the proper scope of the disclosed examples may be defined by the appended claims.

FIG. 1 illustrates a schematic of a printer 100, such as an inkjet printer, according to an example of the present subject matter. The printer 100 may be implemented in different environments, such as offices, homes, industries, or other environments. The printer 100 includes a print head 102 having a plurality of nozzles 104. The plurality of nozzles 104 is collectively referred to as nozzles 104. Further, the plurality of nozzles 104 includes a first set of nozzles 106 located proximal to a feed roller 108.

The feed roller 108 moves a medium 110 along a print path 112. The medium 110 may be a plain medium or a thick medium. Examples of the plain medium may include, but are not limited to, standard paper. Examples of the thick medium may include, but are not limited to, an envelope, a postcard, and a heavy graphics medium. Though the following description describes the medium 110 to be formed from paper, the medium 110 may be made from any type of material, such as cardboard, transparencies, fabric, plastic, and photographic paper.

In an example, the printer 100 may further include a tray (not shown) for storing the medium 110 before initiation of the printing. During printing, the medium 110 is pulled from the tray and provided to the feed roller 108, which in turn moves or advances the medium 110 along the print path 112 for printing.

Further, the printer 100 may include a controller (not shown) that may be operably coupled to the print head 102. The controller may include microprocessors, microcomputers, microcontrollers, digital signal processors, central processing units, state machines, logic circuitries, and/or any other devices that manipulate signals and data based on computer-readable instructions. Further, controller may be provided through the use of dedicated hardware as well as hardware capable of executing computer-readable instructions.

The controller controls various actions performed by the print head 102 and the feed roller 108. For example, the controller determines whether the medium 110 is a plain medium or a thick medium. The manner in which the controller determines a type of the medium 110 may be accomplished in a variety of ways. For example, a user may provide an input regarding the type of the medium 110 that is fed in the tray by the user. The user may provide the input from a keypad of the printer 100 or through a computer connected to the printer 100.

In another example, the controller may automatically determine the type of the medium 110. For instance, the medium 110 may include a code located thereupon. The code may be indicative of the type of the medium 110. Further, a sensor (not shown) placed in the tray may identify the code and generate a signal to the controller to communicate the identified code.

In an aspect, when the input provided by the user indicates the medium 110 to be the thick medium, such as an envelope, the controller may detect a Top-of-Form (TOF), or a leading portion, of the thick medium, when the thick medium advances along the print path 112. The TOF of the medium 110 indicates a print starting position at top of a page. Based on the detection of the TOF, the print head 102 prints on the medium 110 by the first set of nozzles 106. In an example, the first set of nozzles 106 is selected based on a distance between an output roller (not shown) and a first nozzle 104-1. In an example, considering that the nozzles 104 include a total of 1568 nozzles, the first set of nozzles include nozzles from 736 to 1568, which are proximal to the feed roller 108. Thus, as soon as the TOF of the thick medium is detected, the print head 102 positioned above the TOF is triggered to print on the TOF of the thick medium.

Once the TOF is printed, the print head 102 moves away from the print path 112 of the medium 110, such as the thick medium. The movement of the print head 102 out of the print path 112 facilitates in preventing contact between the print head 102 and the medium 110 in case of curving up of the medium 110 due to printing on the TOF. After moving the print head 102, the controller causes the feed roller 108 to move the thick medium further along the print path 112. As a result, the feed roller 108 rotates to advance the thick medium along the print path 112 for printing an intermediate portion and a Bottom-of-Form (BOF) of the thick medium. In an example, the BOF of the thick medium indicates a print ending position at bottom of the thick medium. The printer 100 as described with reference to the present subject matter facilitates in printing thick and plain media types without impacting on throughput of the printer 100. Details pertaining to the printing of the thick medium are provided in conjunction with FIGS. 2(A)-2(D), In another aspect, when the medium 110 is determined as the plain medium, it is ascertained whether the plain medium is subjected to a simplex printing or a duplex printing. In an example, the controller ascertains whether the plain medium is subjected to duplex printing or simplex printing. In the present example, the controller may receive an input from a user of the printer 100 to indicate whether or not the plain medium is subjected to the duplex printing. For example, the user may provide the input while giving a print command. In case of the simplex printing, the print head 102 prints on a TOF of the plain medium through the plurality of nozzles 104 to increase the printing speed. In case of the duplex printing, a density of an ink laid on a BOF of a first side of the plain medium is determined. If the density of the ink on the BOF is above a specific ink density, the print head 102 prints on a TOF of a second side of the plain medium through the first set of nozzles 106.

Further, as described above with reference to the thick medium, the print head 102 is movable away from the print path 112 of the plain medium, upon printing the TOF of the second side of the plain medium. Upon advancement of the plain medium along the print path 112, the print head 102 moves back in the print path 112 to print a remaining printable area of the second side of the plain medium. Details regarding the duplex printing of the plain medium are explained in conjunction with FIGS. 3(A) and 3(B).

Figure 2A:
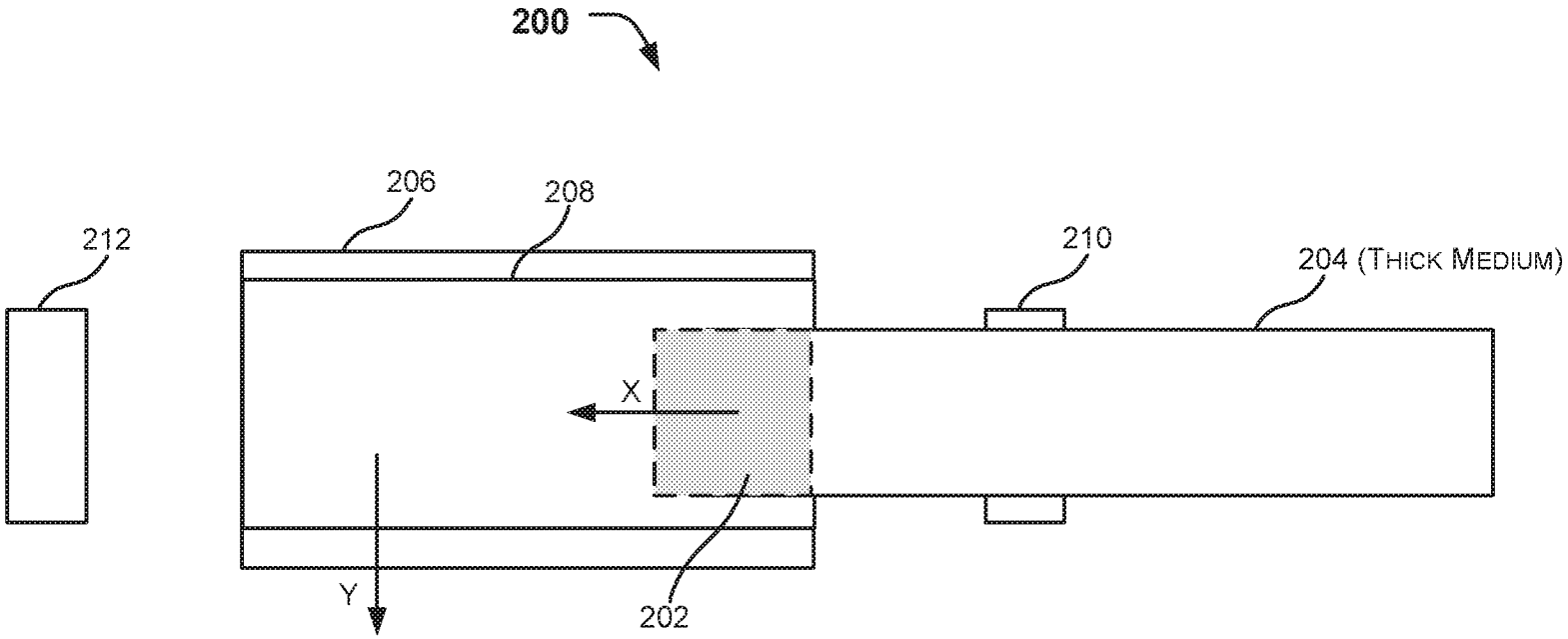
FIG. 2(A) illustrates a top view of a section of a printer for printing a Top-Of-Form (TOF) of a thick medium, according to an example.

FIG. 2(A) illustrates a top view of a section of printer 200 for printing on a TOF 202 of a thick medium 204 (hereinafter referred to as medium 204), according to an example. The printer 200 includes a platen 206 positioned below a print head 208 such that the print head 208 and the platen 206 define a print zone therebetween. The medium 204 is introduced in the print zone through a feed roller 210. The print head 208 and the feed roller 210 are the same as the print head 102 and the feed roller 108 respectively described through the description of FIG. 1. In an example, the feed roller 210 may be provided with a pinch roller (not shown) for nipping the medium 204. Accordingly, the feed roller 210 creates stress on the medium 204, thereby maintaining a flat shape of the medium 204 in the print zone.

In an example, the printer 200 also includes a controller (not shown), such as the controller of the printer 100. The controller causes the print head 208 to detect if the medium 204 has travelled a pre-defined distance in the print zone from the feed roller 210. In the present example, the predefined distance is 32.61 mm and is the distance between a nozzle, such as nozzle 594 under which a top edge of the medium 204 reaches and the feed roller 210. The pre-defined distance is indicative of a distance for maintaining an optimal flatness of the medium 204 in the print zone. Upon detecting that the medium 204 has travelled the pre-defined distance, the print head 208 determines the TOF 202 of the medium 204. In the present example, the print head 208 may include a sensor (not shown) for sensing the TOF 202 of the medium 204.

In an implementation, the controller enables the print head 208 to maintain small margins to be able to efficiently perform a print job. Accordingly, the sensor keeps a margin of 3 mm at a leading portion of the medium 204, before sensing the TOF 202. Upon detection of the TOF 202, the print head 208 initiates printing on the TOF 202 of the medium 204 through the first set of nozzles, such as the first set of nozzles 106, proximal to the feed roller 210. As the remaining medium 204 is passing through the feed roller 210, stress is maintained at the TOF 202 and the smearing of the ink with the printed TOF is prevented. After the TOF 202 of the medium 204 is printed, the print head 208 moves away from a print path of the medium 204, i.e., in a direction indicated by arrow Y. In addition, the medium 204 is advanced in the print zone towards an output roller 212, in a direction as shown by arrow X.

Figure 2B:
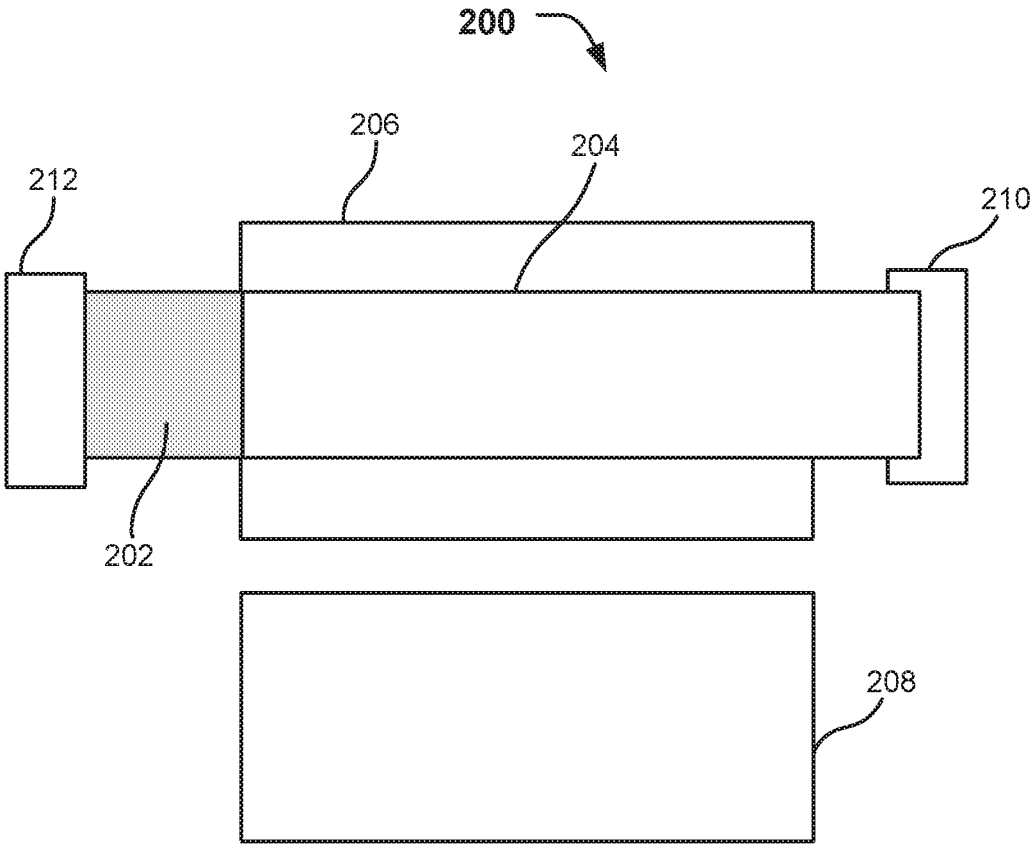
FIG. 2(B) illustrates a top view of a section of a printer or advancing a thick medium in a print zone, according to an example.

Referring to FIG. 2(B), a top view of a section of printer 200 for advancing the medium 204 in a print zone, according to an example. As mentioned with reference to FIG. 2(A), once the TOF 202 of the medium 204 is printed, the print head 208 moves away from the print zone. As may be seen from FIG. 2(B), the print head 208 is parked outside the print path of the medium 204 in the print zone. Accordingly, any contact of the TOF 202 of the medium 204 with the print head 208 is prevented, which also prevents smearing of ink from the print head 208 or jamming of the medium 204.

Once the print head 208 is parked outside the print zone, the feed roller 210 is caused to advance the medium 204 in the print zone. In an example, the controller communicates with the feed roller 210 to advance the medium 204 to move the TOF 202 of the medium 204 towards the output roller 212. In an example, the feed roller 210 rotates to advance the medium 204 by such proportion that the printed TOF 202 of the medium 204 moves out of the print zone and reaches the output roller 212. Such rotation of the feed roller 210 ensures that the printed TOF 202 does not come in contact with the print head 208 during the printing of the remaining medium 204.

Figure 2C:
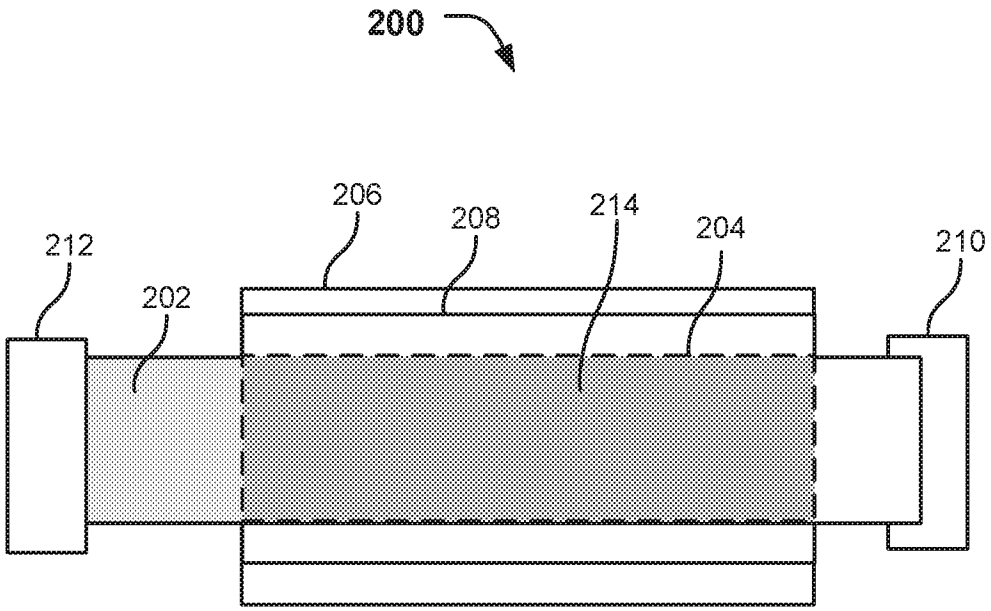
FIG. 2(C) illustrates a top view of a section of a printer for printing an intermediate portion of the thick medium, according to an example.

FIG. 2(C) illustrates a top view of a section of the printer 200 for printing an intermediate portion 214 of the thick medium 204, according to an example. When the medium 204 is advanced in the print zone, the print head 208 is moved back in the print zone. In an example, the controller may cause the print head 208 to move to its previous position along the print path to print the intermediate portion 214 of the medium 204. The controller sends a command to the print head 208 to utilize the plurality of nozzles of the print head 208 to print on the intermediate portion of the medium 204. The usage of the plurality of nozzles while printing the intermediate portion 214 enables the printer 200 in maintaining high throughput.

As mentioned with respect to FIG. 2(B), the feed roller 210 moves the printed TOF towards the output roller 212. In an example, the output roller 212 may be a star-wheel type pinch roller to pinch the printed TOF while transporting the medium 204 out of the printer 200. As the TOF 202 of the medium 204 is held by the output roller 212 and a trailing portion of the medium 204 is held by the feed roller 210, the medium 204 is under continuous stress. Thus, flatness of the medium 204 is maintained within the print zone.

Figure 2D:
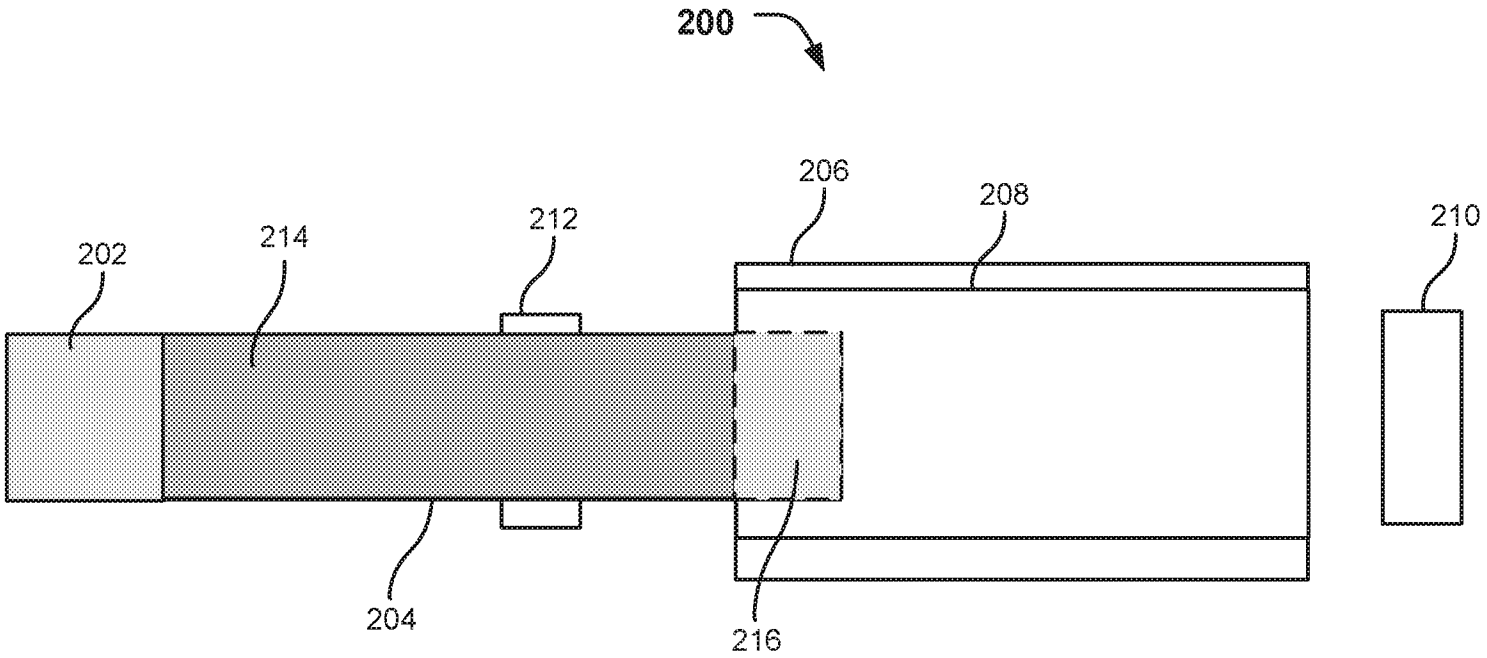
FIG. 2(D) illustrates a top view of a section of a printer for printing a Bottom-Of-Form (BOF) of the thick medium, according to an example.

FIG. 2(D) illustrates a top view of a section of the printer 200 for printing a BOF 216 of the thick medium 204, according to an example. Once the intermediate portion 214 of the medium 204 is printed, the controller causes the output roller 212 to rotate further to advance the medium 204 in the print zone. In the present example, after printing the intermediate portion 214, the print head 208 remains at its position, unlike after printing the TOF 202 of the medium 204.

Further, rotation of the output roller 212 moves the intermediate portion 214 out of the print zone and across the output roller 212. As a result, the BOF 216 of the medium 204 remains within the print zone. To determine that the BOF 216 is within the print zone, the controller communicates with the print head 208 to detect if a pre-defined length of the medium 204 has not crossed the print zone. The pre-defined length of the medium 204 is computed to keep small margins of 3 mm while maintaining stress on the medium 204 to keep the medium 204 levelled within the print zone. In an example, this pre-defined length of the medium 204 is 15 mm.

Upon detecting that the pre-defined length of the medium 204 is remaining within the print zone, the print head 208 determines the BOF 216 of the medium 204. Thereafter, the print head 208 prints on the BOF 216 through a second set of nozzles. The second set of nozzles may include nozzle 1 to nozzle 567. The second set of nozzles is determined based on a distance between a last nozzle (nozzle 1568) and the feed roller 210. In an example, the second set of nozzles is located distal from the feed roller 210. Accordingly, the present subject matter maintains an optimal flatness of the medium 204 in the print zone to avoid smearing of the ink or jamming of the medium 204, while maintaining small margins even for the medium 204.

Figure 3A:
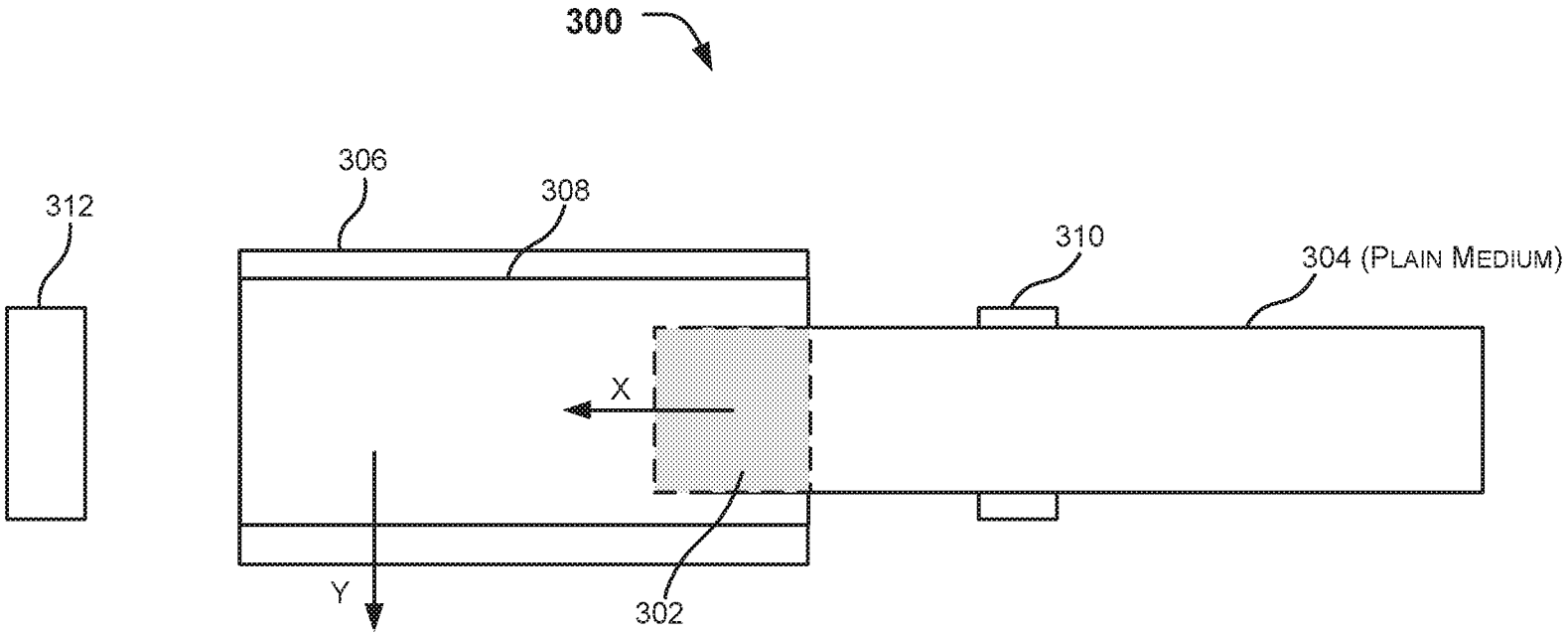
FIG. 3(A) illustrates a top view of a section of a printer for printing a Top-Of-Form (TOF) of a second side of a plain medium, according to an example.

Referring to FIG. 3(A), a top view of a section of a printer 300 for printing a TOF 302 of a second side of a plain medium 304 (hereinafter referred to as medium 304) is illustrated, according to an example. The printer 300 includes a platen 306 and a print head 308 to define a print zone therebetween. Further, the medium 304 is introduced in the print zone through a feed roller 310. The print head 308 and the feed roller 310 are the same as the print head 102 and the feed roller 108, described through the description of FIG. 1. In an example, the feed roller 310 may be provided with a pinch roller (not shown) for nipping the medium 304. The feed roller 310 therefore creates stress on the medium 304, thereby maintaining a flat shape of the medium 304 in the print zone.

The printer 300 initiates printing on the TOF 302 of the second side of the plain medium 304 through the first set of nozzles. In an example, the controller causes the print head 308 to detect if the plain medium 304 has travelled a pre-defined distance in the print zone from the feed roller 310. The pre-defined distance is computed to allow a medium, such as the medium 304, to maintain an optimal flatness in the print zone. In addition, the pre-defined distance allows the feed roller 310 to control a shape of the medium 304 to avoid upward curving of the TOF 302 of the medium 304. Upon detecting that the medium 304 has travelled the pre-defined distance, the print head 308 determines the TOF 302 of the medium 304.

In an implementation, the print head 308 may include a sensor (not shown) for sensing the TOF 302 of the medium 304. The controller enables the print head 308 to maintain small margins to be able to efficiently perform a print job.

Accordingly, the sensor keeps a margin of 3 mm at a leading portion of the medium 304, before sensing the TOF 302. Further, the first set of nozzles is proximal to the feed roller 310. Thus, as soon as the TOF 302 is detected in the print zone, the print head 308 prints on the TOF 302. After printing on the TOF 302 of the medium 304, the print head 308 is moved away from the print zone, i.e., in a direction as shown by arrow Y. In addition, the medium 304 advances in the print zone towards an output roller 312, in a direction as shown by arrow X.

Figure 3B:
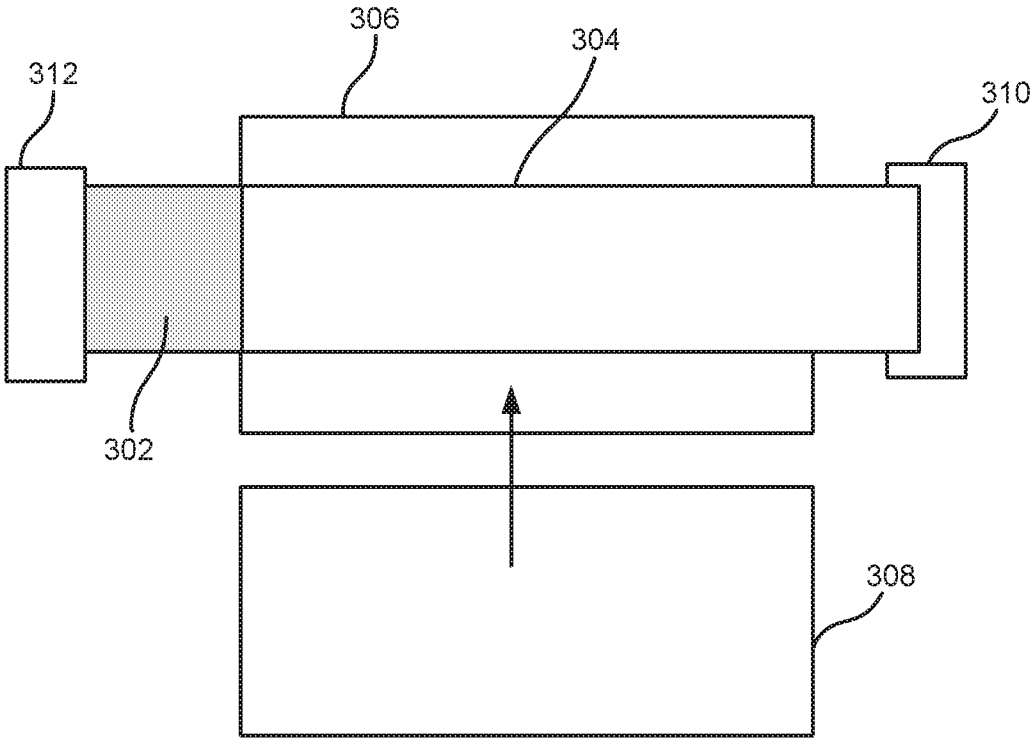
FIG. 3(B) illustrates a top view of a section of a printer for advancing a plain medium in a print zone, according to an example.

FIG. 3(B) illustrates a top view of a section of the printer 300 for advancing the medium 304 in the print zone, according to another example. As mentioned with reference to FIG. 3(A), once the TOF 302 of the medium 304 is printed, the print head 308 moves away from the print zone. Accordingly, the print head 308 parks outside a print path of the medium 304 in the print zone. Thus, the print head 308 prevents any contact with the TOF 302 of the medium 304, thereby reducing smearing of ink from the print head 308 or jamming of the medium 304.

Once the print head 308 has parked outside the print path, the feed roller 310 is caused to advance the medium 304 in the print zone. In an example, the controller causes the feed roller 310 to rotate to advance the medium 304 to move the TOF 302 of the medium 304 towards the output roller 312. In an example, the feed roller 310 advances the medium 304 by such proportion that the printed TOF 302 of the medium 304 moves out of the print zone.

Thereafter, the print head 308 is moved back in the print zone by the controller to print a remaining printable area of the second side of the medium 304. In an example, the print head 308 utilizes all nozzles thereof to print on the remaining printable area to increase the throughput.

Figure 4:
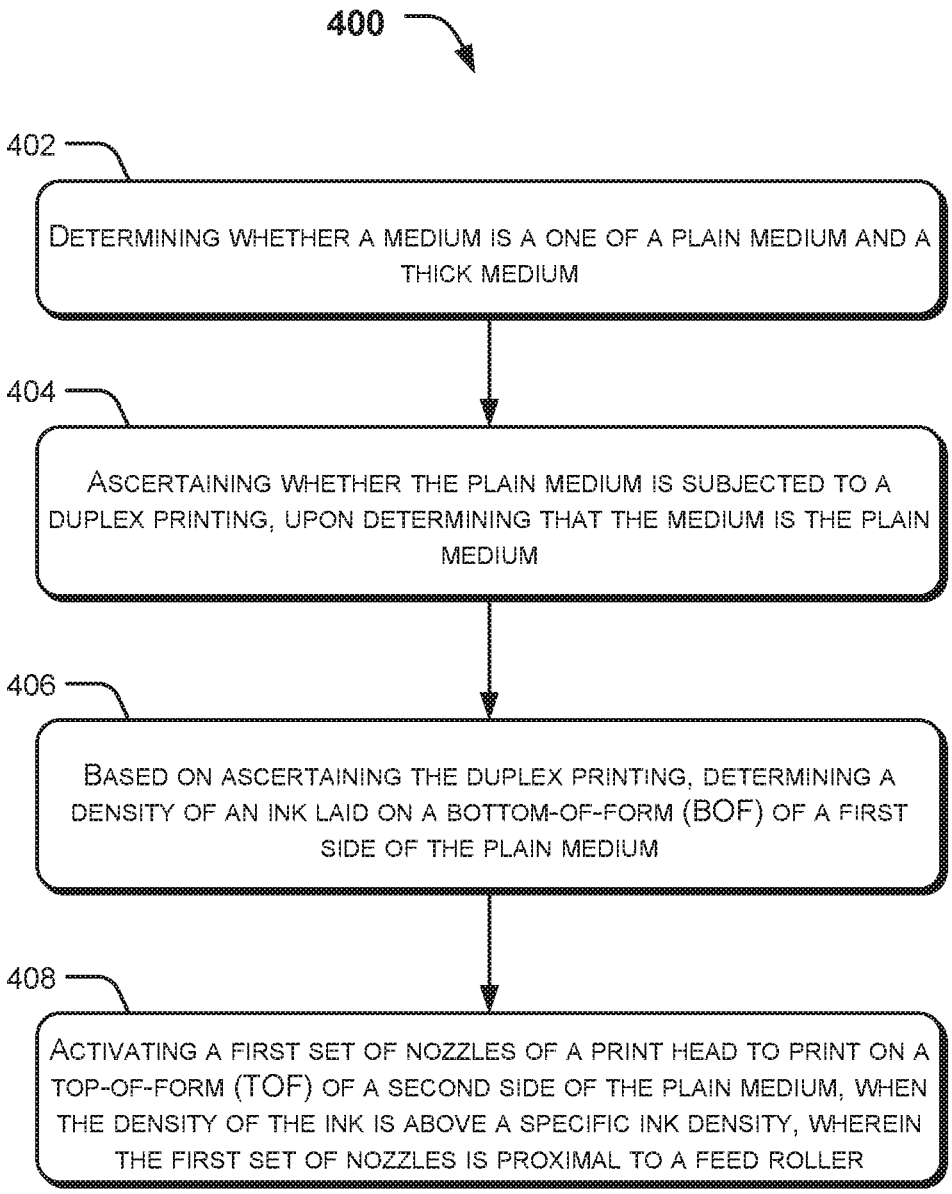
FIG. 4 illustrates a method of printing on a plain medium, according to an example.
Figure 5A:
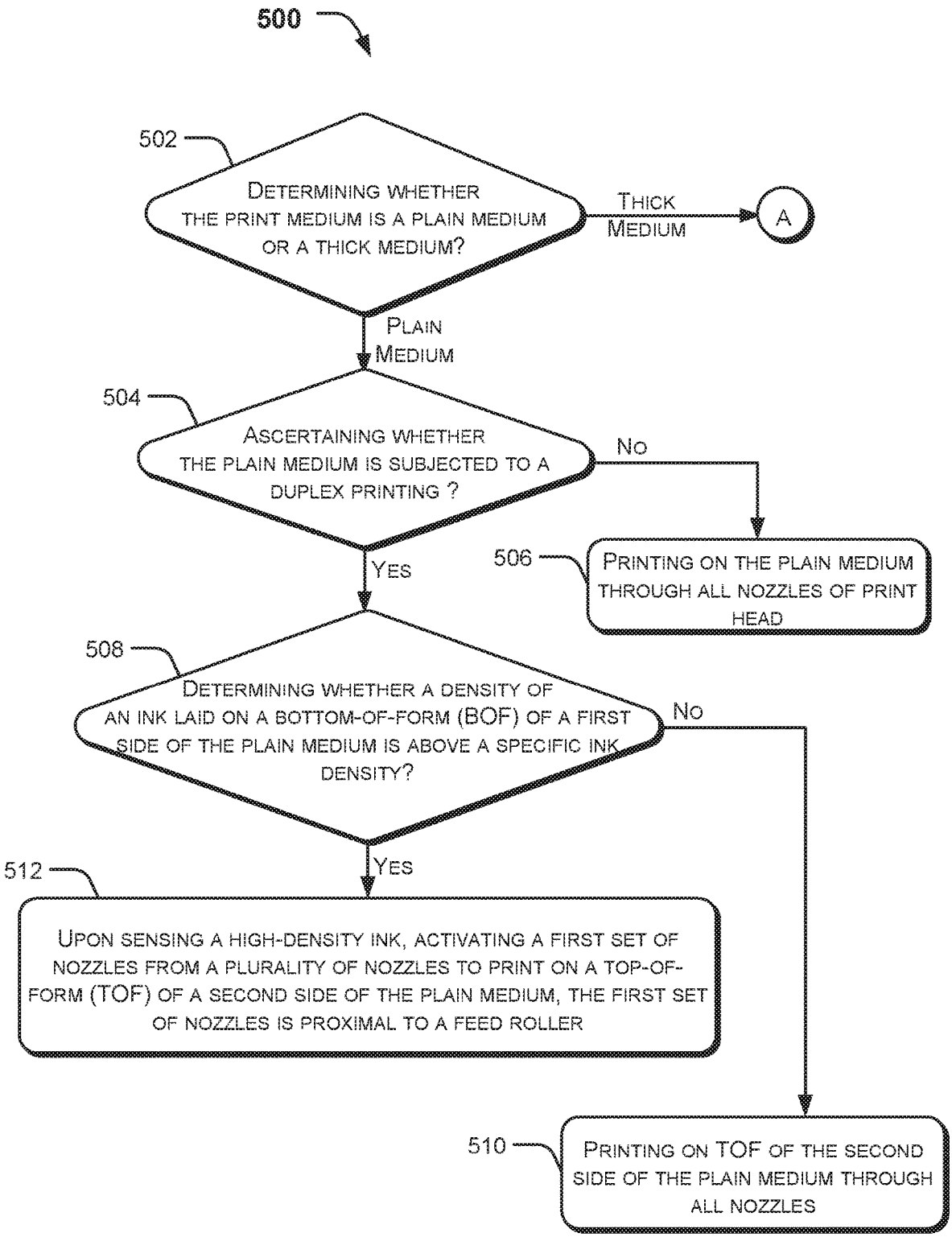
FIG. 5(A) illustrates a method of printing on a plain medium, according to an example.
Figure 5B:
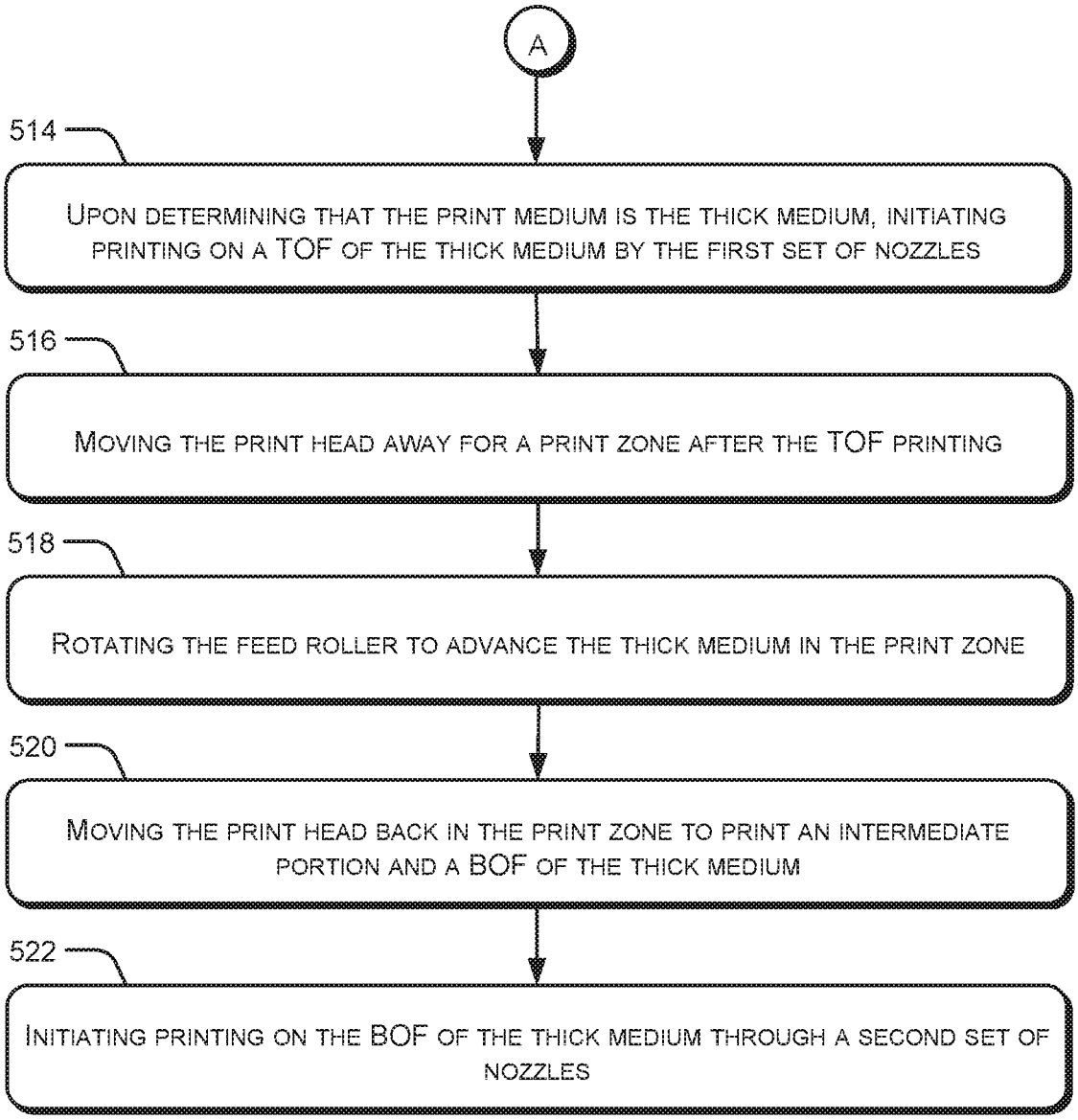
FIG. 5(B) illustrates a method of printing on a thick medium, according to an example.

FIGS. 4, 5(A), and 5(B) illustrate methods 400 and 500 of printing on a print medium, such as the medium 110, according to various examples. The methods 400 and 500 describe printing on the medium 110 of variable thickness, such as envelopes and plain papers, through a printer 100. In an example, the printer 100 includes a print head 102, a plurality of nozzles 104 for ejecting ink on the medium 110, and a feed roller 108 for transporting the medium 110 along a print path below the print head 102. The printer 100 further includes a platen positioned below the print head 102, to support the medium 110 during printing The print head 102 and the platen define a print zone therebetween, The methods 400 and 500 can be implemented by processor(s) or device(s) through any suitable hardware, a non-transitory machine-readable medium, or a combination thereof. Further, although the methods 400 and 500 are described in context of the printer that is similar to the aforementioned printer 100, other suitable devices or systems may be used for execution of the methods 400 and 500.

In some example, processes involved in the methods 400 and 500 can be executed based on instructions stored in a non-transitory computer-readable medium. The non-transitory computer-readable medium may include, for example, digital memories, magnetic storage media, such as a magnetic disks and magnetic tapes, hard drives, or optically readable digital data storage media.

Referring to FIG. 4, at block 402, it is determined whether the medium 110 is a plain medium or a thick medium. In an example, a controller determines whether the medium 110 is a plain medium or a thick medium.

At block 404, upon determining that the medium 110 is the plain medium, it is ascertained whether the plain medium is subjected to a duplex printing, In an example, the controller may receive the instructions from the user, when the user gives a print command.

At block 406, it is determined whether a density of an ink laid on a BOF of a first side of the plain medium is above a specific ink density. In an example, the specific ink density is based on a time taken by the ink laid on the BOF of the first side of the plain medium to dry.

At block 408, upon determining that the density of the ink is above the specific ink density, a first set of nozzles 106 from the plurality of nozzles 104 of the print head 102 is activated to print on a TOF of the second side of the plain medium. The TOF indicates a print starting position at top of a page.

Referring to FIG. 5(A), at block 502, it is determined whether the medium 110 is a plain medium or a thick medium. In an example, a controller determines whether the medium 110 is a plain medium or a thick medium. The controller may receive input from a user regarding the type of the medium 110. The user may provide an input regarding a type of the medium 110 that is fed in a tray by the user. The user may provide the input from a keypad of the printer 100 or through a computer connected to the printer 100.

At block 504, upon determining that the medium 110 is the plain medium, it is ascertained whether the plain medium is subjected to a duplex printing. In an example, the controller may receive the instructions from the user, when the user gives a print command. If the plain medium is not subjected to duplex printing, the method 500 moves to block 506. At block 506, the printer 100 prints on the plain medium through all the nozzles 104 of the print head 102. If the plain medium is subjected to the duplex printing, the method 500 moves to block 508.

At block 508, it is determined whether a density of an ink laid on a BOF of a first side of the plain medium is above a specific ink density. In an example, the specific ink density is based on a time taken by the ink laid on the BOF of the first side of the plain medium to dry. For example, the density of the ink laid on the BOF of the first side of the plain medium is considered above the specific ink density, when a dry time of the ink laid on the BOF is more than 5 seconds. If the density of the ink is below the specific ink density, the method 500 moves to block 510.

At block 510, a normal print action is performed on a second side of the plain medium. In an example, in the normal print action, the controller does not detect a TOF on the second side of the plain medium. Instead, the controller enables the print head 102 to print on the second side through all nozzles 104. If the density of the ink is above the specific ink density, the method 500 moves to block 512.

At block 512, upon determining that the density of the ink is above the specific ink density, a first set of nozzles 106 from the plurality of nozzles 104 is activated to print on a TOF of the second side of the plain medium. The TOF indicates a print starting position at top of a page. In an example, the controller triggers the print head 102 to employ the first set of nozzles 106 to print on the TOF of the second side of the plain medium. The first set of nozzles 106 is proximal to the feed roller 108.

Once the print head 102 prints on the TOF of the second side of the plain medium, the print head 102 is moved away from a print zone to prevent any contact between the print head 102 and printed TOF the second side of the plain medium. Thereafter, the plain medium is advanced in the print zone to move the printed TOF of the second side of the plain medium away from the feed roller 108 and towards the output roller. Further, the print head 102 is moved back in the print zone to print a remaining printable area of the second side of the plain medium. In an example, the print head 102 employs all nozzles 104 to print on the remaining printable area.

Referring to FIG. 5(B), at block 514, upon determining that the medium is the thick medium, printing is initiated on a TOF of the thick medium by the first set of nozzles 106, proximal to the feed roller 108. In an example, upon detection of the TOF of the thick medium, the controller triggers the print head 102 to eject the ink on the TOF of he thick medium through the first set of nozzles 106.

At block 516, once the TOF of the thick medium is printed, the print head 102 is moved away from the print zone. In an example, the controller communicates with the print head 102 to move out of the print zone. The movement of the print head 102 facilitates in preventing contact between the print head 102 and the thick medium, thereby reducing smearing of the ink.

At block 518, the feed roller 108 is rotated to advance the thick medium in the print zone. In an example, the controller commands the feed roller 108 to release the thick medium in the print zone, once the print head 102 has moved out of a print path of the thick medium. In an implementation, the feed roller 108 advances the thick medium in a manner such that the printed TOF moves out of the print zone and reaches an output roller.

At block 520, the print head 102 is moved back in the print zone to print an intermediate portion and a BOF of the thick medium. In an example, once the printed TOF of the thick medium moves out of the print zone. In an implementation, the controller triggers the print head 102 to print on the intermediate portion of the thick medium through all of the nozzles 104. The usage of all nozzles while printing the intermediate portion enables the printer 100 in maintaining high throughput.

At block 522, printing is initiated on a BOF of the thick medium through a second set of nozzles. In an example, after printing on the intermediate portion, the feed roller 108 rotates to advance the thick medium further in the print zone. While advancing the thick medium, the print head 102 detects if a pre-defined length of the thick medium remains in the print zone. The pre-defined length of the thick medium includes the BOF of the thick medium and a margin of 3 mm at an end of the thick medium. In an example, this pre-defined length of the thick medium is 15 mm. Further, the second set of nozzles is distal from the feed roller 108.

Figure 6:
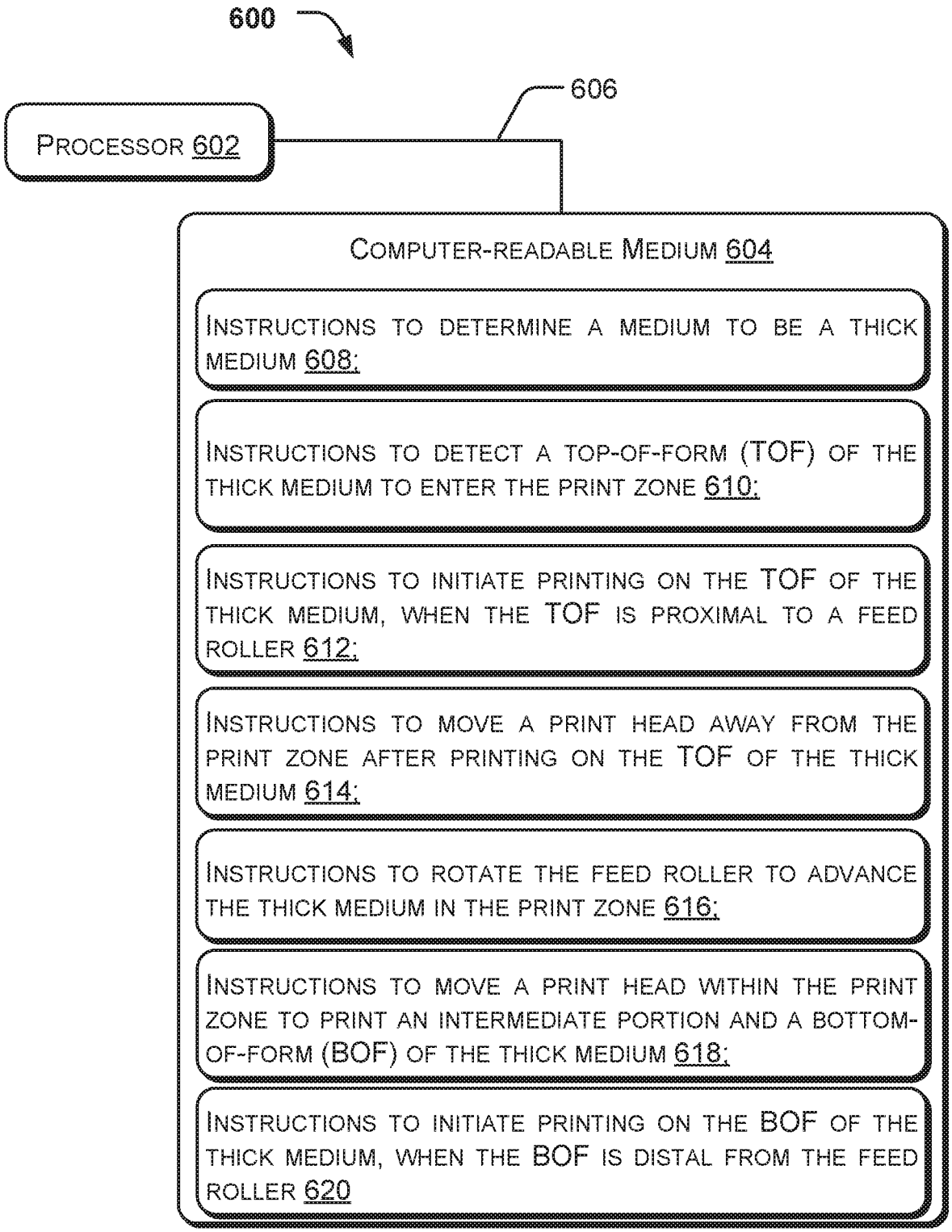
FIG. 6 illustrates a system environment implementing a non-transitory computer readable medium for printing on a thick medium, according to an example.

FIG. 6 illustrates a system environment 600 implementing a non-transitory computer readable medium for printing on a medium, such as a paper, according to an example. The system environment 600 includes a processor 602 communicatively coupled to the non-transitory computer-readable medium 604 through a communication link 606. In an example, the processor 602 may be a controller of a printer for fetching and executing computer-readable instructions from the non-transitory computer-readable medium 604. The printer may be the printer 100 as described with reference to FIG. 1.

The non-transitory computer-readable medium 604 can be, for example, an internal memory device or an external memory device. In an example, the communication link 606 may be a direct communication link, such as any memory read/write interface. In another example, the communication link 606 may be an indirect communication link, such as a network interface. In such a case, the processor 602 can access the non-transitory computer-readable medium 604 through a communication network (not shown).

In an example, the non-transitory computer-readable medium 604 includes a set of computer-readable instructions for printing on the medium. The set of computer-readable instructions may include instructions as explained in conjunction with FIGS. 1-3(B). The set of computer-readable instructions can be accessed by the processor 602 through the communication link 606 and subsequently executed to perform acts for printing on the medium.

Referring to FIG. 6, in an example, the non-transitory computer-readable medium 604 may include instructions 608 to determine the medium to be a thick medium. In an example, the thick medium may include multiple layers of medium, such as an envelope. For example, the user may provide an input regarding a type of the medium that is fed in a tray by the user. In another example, the printer 100 may automatically determine the type of medium. The non-transitory computer-readable medium 604 may include instructions 610 to detect a TOF of the thick medium to enter a print zone. In an example, the print head 102 may include a sensor for detecting the TOF of the thick medium in the print zone. In the present example, the sensor detects if the thick medium has travelled a pre-defined distance in the print zone from the feed roller 108, the sensor indicates that the TOF of the thick medium has entered the print zone. The pre-defined distance is computed to allow a medium, such as the thick medium, to maintain an optimal flatness in the print zone.

Further, the non-transitory medium 604 may include instructions 612 to initiate printing on the TOF of the thick medium, when the TOF is proximal to the feed roller 108. In an example, the print head 102 initiates printing on the TOF of the thick medium through a first set of nozzles. As the thick medium is being fed from the feed roller 108, the feed roller 108 pinches the thick medium to create a stress on the TOE The non-transitory medium 604 may include instructions 614 to move the print head 102 away from the print zone, after printing on the TOF of the thick medium. The print head 102 moves out of a print path of the thick medium thereby preventing smearing of the ink.

In addition, the non-transitory medium 604 may include instructions 616 to rotate the feed roller 108 to advance the thick medium in the print zone. In an example, the feed roller 108 is rotated in a manner to move the printed TOF of the thick medium out of the print zone towards the output roller. The non-transitory medium 604 may include instructions 618 to move the print head 102 within the print zone for printing an intermediate portion and a BOF of the thick medium. In an example, the print head 102 prints on the intermediate portion with all nozzles 104 thereof. Further, the non-transitory medium 604 may include instructions 620 to initiate printing on the BOF of the thick medium, when the BOF of the thick medium is distal from the feed roller 108.

Further, in an example, the non-transitory computer-readable medium 604 may include instructions upon determining that the medium is the plain medium, ascertain whether the plain medium is subjected to a duplex printing. For example, the user may provide an input regarding the duplex printing. The non-transitory computer-readable medium 604 may include instructions to determine whether a density of ink laid on a BOF of a first side of the plain medium is above a specific ink density, upon ascertaining the duplex printing. The specific ink density is based on a time taken by the ink laid on the BOF of the first side of the plain medium to dry. The non-transitory computer-readable medium 604 may include instructions to initiate printing on a TOF of a second side of the plain medium, upon determining that the density of the ink on the BOF of the first side is above the specific ink density.

In addition, the non-transitory computer-readable medium 604 may include instructions to move the print head away from the print zone after printing the TOF of the second side of the plain medium. The non-transitory computer-readable medium 604 may further include instructions to cause the plain medium advance in the print zone. In an example, the feed roller may receive instructions from the controller to rotate such that the printed TOF of the second side of the plain medium is out of the print zone. The non-transitory computer-readable medium 604 may include instructions to move the print head back in the print zone to print a remaining printable area of the second side of the plain medium.

Although examples for the present disclosure have been described in language specific to structural features and/or methods, it is to be understood that the appended claims are not limited to the specific features or methods described herein. Rather, the specific features and methods are disclosed and explained as examples of the present disclosure.

We claim:

1. A printer comprising:

a feed roller to move a medium along a print path; and a print head having a plurality of nozzles, the plurality of nozzles includes a first set of nozzles being located proximal to the feed roller, the first set of nozzles is to print on a Top-of-Form (TOF) of a thick medium on the print path, wherein the print head is movable away from the print path after the TOF is printed and is movable back in the print path to print on an intermediate portion and a Bottom-of-Form (BOF) of the thick medium.

2. The printer as claimed in claim 1, wherein the plurality of nozzles is to print on the intermediate portion of the thick medium.

3. The printer as claimed in claim 1, wherein the plurality of nozzles comprises a second set of nozzles to print on the BOF of the thick medium, the second set of nozzles being located distal from the feed roller.

4. The printer as claimed in claim 1, wherein the first set of nozzles is to print on a TOF of a second side of a plain medium when a density of an ink laid on a BOF of a first side of the plain medium is above a specific ink density, wherein the print head is movable away from the print path after the TOF is printed and is movable back in the print path to print a remaining printable area of the second side of the plain medium..

5. The printer as claimed in claim 4, wherein the plurality of nozzles is to print the remaining printable area of the second side of the plain medium after the TOF is printed.

6. The printer as claimed in claim 4, wherein the specific ink density is based on a time taken by the ink laid on the BOF of the first side of the plain medium to dry.

7. The printer as claimed in claim 1, further comprising a controller operably coupled to the print head, the controller is to determine whether the medium is one of a plain medium and a thick medium.

8. A method comprising:

determining, by a processor, whether a medium is one of a plain medium and a thick medium;

ascertaining whether the plain medium is subjected to a duplex printing, upon determining that the medium is the plain medium;

based on ascertaining the duplex printing, determining a density of an ink laid on a Bottom-of-Form (BOF) of a first side of the plain medium; and activating a first set of nozzles of a print head to print on a Top-of-Form (TOF) of a second side of the plain medium, when the density of the ink is above a specific ink density, wherein the first set of nozzles is proximal to a feed roller.

9. The method as claimed in claim 8, wherein the specific ink density is based on a time taken by the ink laid on the BOF of the first side of the plain medium to dry.

10. The method as claimed in claim 8, further comprising:

moving the print head away from a print zone after the TOF printing of the second side of the plain medium;

advancing the plain medium on the print zone to move the TOF of the plain medium away from the feed roller; and moving the print head back in the print zone to print a remaining printable area of the second side.

11. The method as claimed in claim 8, wherein upon determining that the medium is the thick medium, initiating printing on a TOF of the thick medium by the first set of nozzles;

moving the print head away from a print zone after the TOF printing;

rotating the feed roller to advance the thick medium in the print zone; and moving the print head back in the print zone for printing an intermediate portion and a BOF of the thick medium.

12. The method as claimed in claim 11, wherein printing on the BOF of the thick medium comprises printing through a second set of nozzles from the plurality of nozzles, wherein the second set of nozzles is distal from the feed roller.

13. A non-transitory computer-readable medium comprising computer-readable instructions, which, when executed by a processor of a printer, cause the processor to;

determine a medium to be a thick medium;

detect a Top-of-Form (TOF) of the thick medium to enter a print zone;

initiate printing on the TOF of the thick medium, when the TOF is proximal to a feed roller;

move a print head away from the print zone after printing on the TOF of the thick medium;

rotate the feed roller to advance the thick medium in the print zone;

move the print head within the print zone to print an intermediate portion and a Bottom-of-Form (BOF) of the thick medium; and initiate printing on the BOF of he thick medium, when the BOF is distal from the feed roller.

14. The non-transitory computer-readable medium as claimed in claim 13, wherein the instructions which, when executed by the processor, cause the processor to:

based on determining that the medium is the plain medium, ascertain whether the plain medium is subjected to a duplex printing;

based on ascertaining the duplex printing, determine whether a density of an ink laid on a BOF of a first side of the plain medium is above a specific ink density; and upon determining that the density of the ink is above the specific ink density, initiate printing a TOF of a second side of the plain medium.

15. The non-transitory computer-readable medium as claimed in claim 14, wherein the instructions which, when executed by the processor, cause the processor to:

move the print head away from the print zone after printing the TOF of the second side of the plain medium;

cause the plain medium to advance on the print zone; and move the print head back in the print zone to print a remaining printable area of the second side.

* * * * *